United States Patent [19]

Le Caér et al.

[11] Patent Number: 4,595,429

[45] Date of Patent: Jun. 17, 1986

[54] AMORPHOUS OR MICROCRYSTALLINE ALUMINUM-BASE ALLOYS

[75] Inventors: Gérard Le Caér, Nancy; Jean-Marie Dubois, Pompey, both of France

[73] Assignee: Centre National de la Recherche Scientifique "CNRS", Paris, France

[21] Appl. No.: 506,993

[22] Filed: Jun. 23, 1983

[30] Foreign Application Priority Data

Jul. 6, 1982 [FR] France ..... 82 12404

[51] Int. Cl.[4] ..... C22C 0/00

[52] U.S. Cl. ..... 148/403; 148/438; 148/439

[58] Field of Search ..... 148/403, 437, 438, 439

[56] References Cited

U.S. PATENT DOCUMENTS 4,347,076 8/1982 Ray et al. ..... 148/437

OTHER PUBLICATIONS

"Freeze Dried" Aluminum Alloys Comes of Age, Materials Engineering, Oct. 1981, p. 62.

*Primary Examiner*—R. Dean

*Attorney, Agent, or Firm*—Oblon, Fisher, Spivak, McClelland & Maier

[57] ABSTRACT

The present invention relates to substantially amorphous or microcrystalline aluminium-base alloys.

Such alloys are of the following chemical composition:

$$Al_aM_bM'_cX_dY_e$$

in which:

$50 \leqq a \leqq 95$ atom %

M representing one or more metals of the group Mn, Ni, Cu, Zr, Ti, V, Cr, Fe and Co with:

$0 \leqq b \leqq 40$ atom %

M′ representing Mo and/or W with:

$0 \leqq c \leqq 15$ atom %

X representing one or more elements of the group Ca, Li, Mg, Ge, Si and Zn, with:

$0 \leqq d \leqq 20$ atom %

Y representing the inevitable production impurities such as O, N, C, H, He, Ga, etc . . . , the proportion of which does not exceed 3 atom %.

The alloys according to the invention can be produced by means of known methods in the form of wires, strips, bands, sheets or powders in the amorphous or microcrystallized state, the grain size of which is less than 1000 nm, preferably 100 nm. They may be used either directly or as means for reinforcing other materials, or as surface coatings which are resistant to corrosion or wear.

7 Claims, 4 Drawing Figures

AMORPHOUS OR MICROCRYSTALLINE ALUMINUM-BASE ALLOYS

The invention relates to substantially amorphous or microcrystalline Al-base alloys.

There are many alloys in an amorphous state, which are produced by rapid cooling at a rate which is generally higher than $10^{5}$° C./sec from a random state (liquid or vapour). In particular, alloys of type $T_iX_j$ are known, in which T represents one or more transition metals (in particular iron) and X represents one or more metalloids (or nonmetalloids) such as B, P, Si, C, Al, and with $i \div 50$ atom %. In such alloys, Al occurs as a minor element, the proportion of which, generally of the order of 10 atom %, does not exceed 35 atom %.

For Al-base alloys (containing more than 50 atom % Al), the technical literature reports on attempts to produce amorphous alloys, which were carried out in relation to binary alloys containing Bi, Cd, Cu, Ge, In, Mg, Ni, Pd, Si, Cr, Ag or Zn, but only four of them, Al-Ge, Al-Pd, Al-Ni, Al-Cr were found to be very locally amorphous (regions which are visible in electron microscopy), and that occurs with very high rates of cooling of the order of $10^9$ to $10^{10}$ K./sec, which are very difficult to attain on an industrial scale: see T R ANANTHARAMAN et al 'Rapidly Quenched Metals III', volume 1, Editor B Cantor, The Metals Society, London (1978) page 126 and P FURRER and WARLIMONT, Mat Science and Eng, 28 (1977) page 127.

With regard to ternary alloys, amorphous alloys were produced by A INOUE et al, (Journal of Mat Science 16, 1981, page 1895) but they relate to the systems (Fe, Co, Ni)-Al-B, which may contain up to 60 atom % Al and generally from 15 to 45–50 atom % B.

The invention therefore concerns alloys based on Al, free from boron, which can be produced in a substantially amorphous or microcrystalline state, by cooling at rates of the order of $10^5$ to $10^6$ K./sec, which can be attained on an industrial scale, from a liquid or gaseous state.

The expression substantially amorphous alloy is used to denote a state in which the atoms are not in any order at a great distance, characterised by broad and diffuse X-ray diffraction spectra, without characteristic lines of the crystallised state; corresponding electron microscope investigations show that more than 80% by volume of the alloy is amorphous.

The expression microcrystalline state is used to denote an alloy in which 20% of the volume or more is in a crystallised state and in which the mean dimension of the crystallites is less than 1000 nm, preferably less than 100 nm (1000 Å). Said mean dimension is evaluated from the mid-height width of the line of the dense planes of the alloy, or by electron microscopy (in the black field). In that state, the diffraction lines at low angles ($\theta < 22°$) have disappeared.

The microcrystalline alloys are generally produced either directly from the liquid state or by thermal crystallisation treatment above the initial crystallisation temperature Tc of the amorphous alloy (that is determined hereinafter by differential enthalpic analysis, with a heating rate of 10° C./min). The alloys according to the invention have the following chemical composition, defined by the formula:

$$Al_aM_bM'_cX_dY_e$$

in which:

$50 \leqq a \leqq 95$ atom %

M representing one or more metals of the group Mn, Ni, Cu, Zr, Ti, V, Cr, Fe, and Co with $0 \leqq b \leqq 40$ atom %

M' representing Mo and/or W with $0 \leqq c \leqq 15$ atom %

X representing one or more elements of the group Ca, Li, Mg, Ge, Si, Zn with $0 \leqq d \leqq 20$ atom %

Y representing the inevitable production impurities such as O, N, C, H, He, Ga, etc, the total proportion of which does not exceed 3 atom %, in particular for the lightest elements, but which are preferably held at a level below 1 atom %.

The proportion of additional elements is limited in an upward direction by virtue of metallurgical considerations (melting temperature, viscosity, surface tension, oxidisability, etc) but also in consideration of economic factors (price and availability). The Mo and W are limited to 15% as they substantially increase the density and the melting point of the alloy.

It has been found that it is easlier to produce a substantially amorphous or microcrystalline alloy if the proportion of Al is limited in an upward direction to 85 atom %.

Substantially amorphous or microcrystalline alloys were produced with alloys containing between 6 and 25 atom % of Cu, with a value of $15 \leqq b \leqq 40$ atom %, with the level of impurities being held at less than 1 atom %.

Preferred compositions comprise individually or in combination, from 0.5 to 5 atom % Mo, from 0.5 to 9 atom % Si, from 5 to 25 atom % V and 7 to 25 atom % Ni.

BRIEF DESCRIPTION OF THE DRAWINGS

The drawings and Examples illustrate the invention.

EXAMPLE 1

Various alloys were poured in a helium atmoshere at 30 kPa (0.3 bar) from a liquid bath in a quartz crucible, on to the outside of a mild steel drum with a diameter of 25 cm, rotating at a speed of 3000 rpm ($V \simeq 40$ m/sec), so as to produce a strip measuring about 2 mm × 20 μm in cross-section.

The results of micro-hardess and/or X-ray study obtained thereon are set out in Table I below.

EXAMPLE 2

Figure 1A:
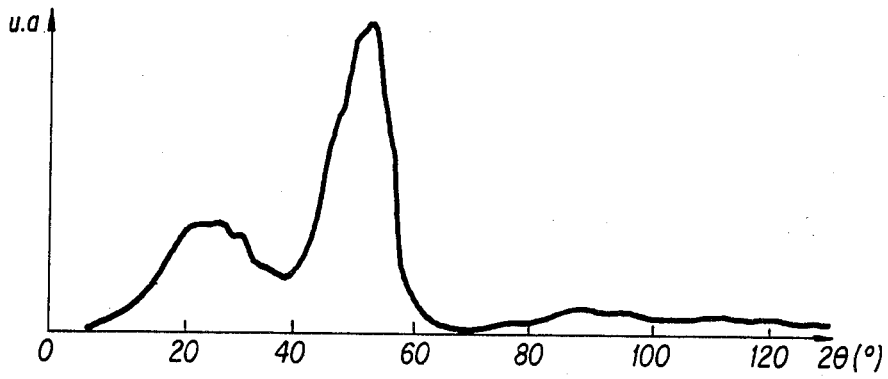
FIG. 1*a* shows the diagram of the amorphous alloy, FIG. 1*b* being a part of the FIG. 1*a* diagram on an enlarged scale.
Figure 1B:
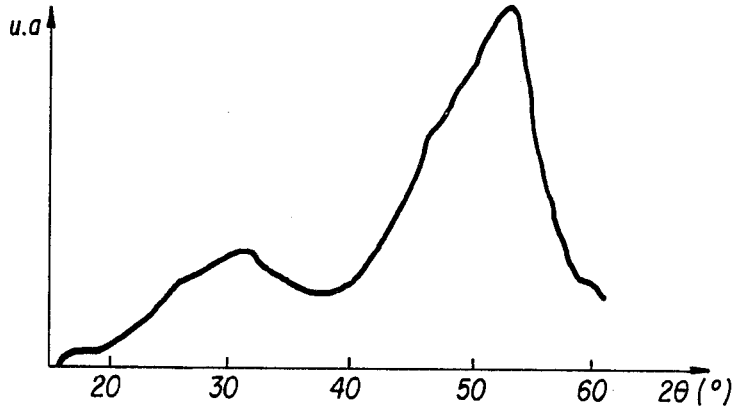
FIG. 1 shows the X-ray diagram of an alloy $Al_{80}Cu_{10}Ni_8Mo_2$, which is produced by means of monochromatic radiation of Co ($\lambda = 0.17889$ nm).
FIG. 1*c* shows the diffraction diagram of the corresponding crystallised alloy.
Figure 1C:
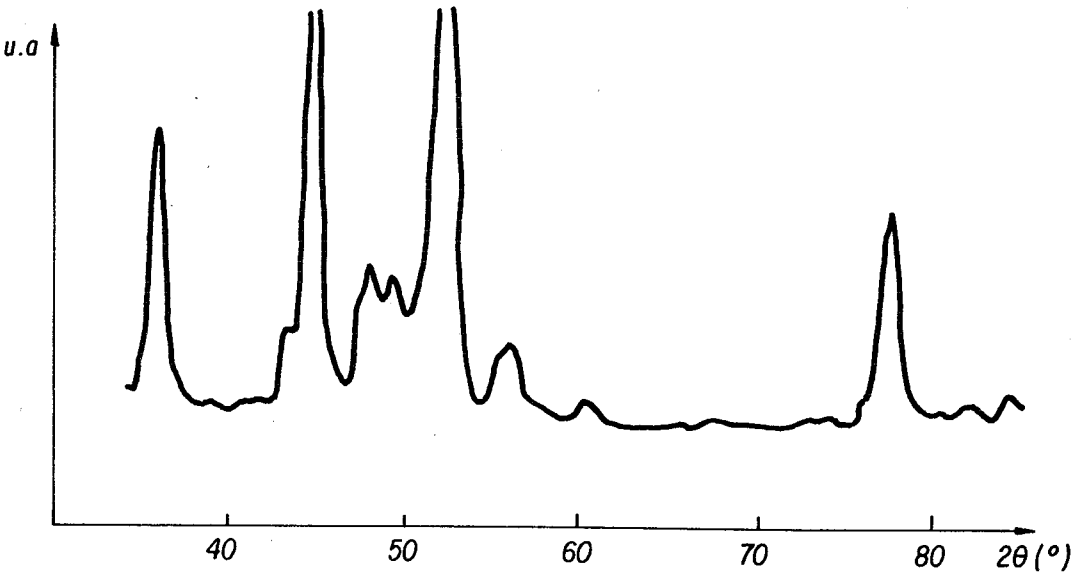
Figure 2:
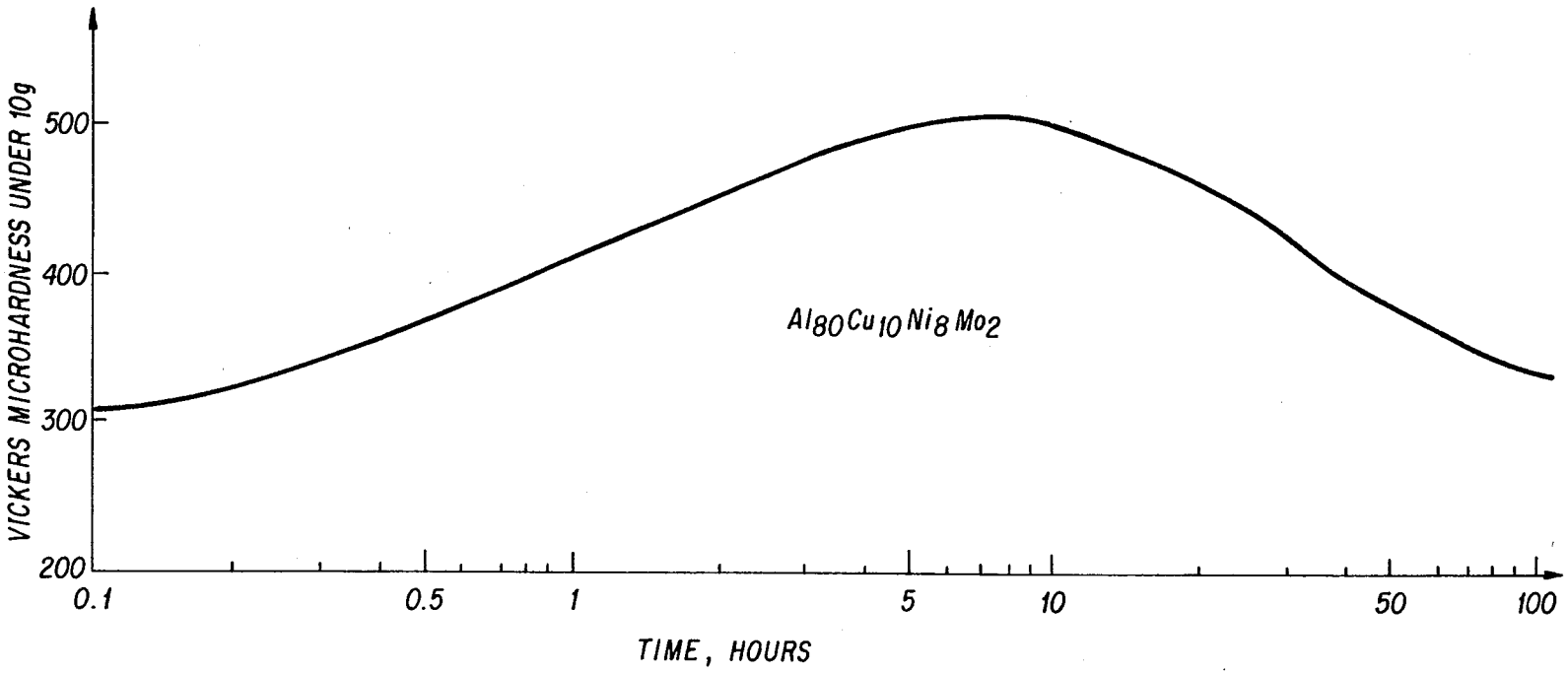
FIG. 2 shows the variation in hardness of the amorphous alloy according to the invention, versus time, when maintained at a temperature of 150° C.

The alloy $Al_{80}Cu_{10}Ni_8Mo_2$ produced above, which has a crystallisation temperature Tc = 156° C. and a density of 3.7 g/cm$^3$, and with a ratio in respect of electrical resistance in the amorphous state, relative to resistance in the crystallised state, at 300° K., of 7, was held at a temperature of 150° C.; FIG. 2 shows the variation in Vickers micro-hardness, under 10 g, in that test: it reaches about 500 HV, after 10 hours.

EXAMPLE 3

The alloy $Al_{72}Cu_{15}V_{10}Mo_1Si_2$ prepared as in Example 1 has a crystallisation temperature of 360° C. and a density of 3.6 g/cm$^3$. Its micro-hardness reaches 750 HV after being held at 400° C. for half an hour and 840 HV after being held at 450° C. for half an hour.

The very high levels of hardness are advantageous with regard to producing powders with a very high level of chemical homogeneity, by crushing.

The alloys according to the invention may be produced using known methods, in the form of wires, strips, bands, sheets or powders in the amorphous state and/or in the microcrystallised state. They may be used either directly or as means for reinforcing other materials or they may also be used for producing surface coatings for enhancing corrosion or wear resistance.

TABLE I

| COMPOSITION | POURING TEMPERATURE (°C.) | VICKERS MICROHARDNESS UNDER 10 g | STATE X |
|---|---|---|---|
| $Al_{72}Cu_{15}V_{10}Mo_1Si_2$ | 1140 | 500 | A |
| $Al_{80}Cu_9Ni_7Mo_1Si_3$ | 850 | 400 | A |
| $Al_{75}Cu_{12}Ni_{10}Mo_1Si_2$ | 850 | 260 | A |
| $Al_{75}Cu_{11}Ni_9Mo_2Si_3$ | 850 | 220–410 | A |
| $Al_{70}Cu_{13}Ni_{11}Mo_3Si_3$ | 850 | 490 | A |
| $Al_{65}Cu_{16}Ni_{12}Mo_3Si_4$ | 850 | 410 | A |
| $Al_{80}Cu_{10}Ni_8Mo_2$ | 850 | 310–360 | A |
| $Al_{60}Cu_{21}V_{14}Mo_2Si_3$ | 1300 | — | A |
| $Al_{77}Cu_{12}V_8Mo_1Si_2$ | — | — | A |
| $Al_{85}Cu_8V_5Mo_1Si_1$ | — | — | A |
| $Al_{80}Cu_{10}V_7Mo_1Si_2$ | — | — | A |
| $Al_{65}Cu_{18}V_{12}Mo_2Si_3$ | — | — | m |
| $Al_{72}Cu_{10}V_{14.5}Mo_1Si_{2.5}$ | — | — | m |
| $Al_{69}Cu_{17}Fe_{10}Mo_1Si_3$ | — | — | m |
| $Al_{72}Cu_{16.5}Fe_8Mo_1Si_{2.5}$ | — | — | m |
| $Al_{75}Cu_{14}Fe_7Mo_1Si_3$ | — | — | m |
| $Al_{78}Cu_{12}Fe_6Mo_1Si_3$ | — | — | m |
| $Al_{77}Cu_{12}Zr_8Mo_1Si_2$ | 1250 | 400 | A - m |
| $Al_{77}Cu_{12}Ti_8Mo_1Si_2$ | 1100 | 420 | A - m |
| $Al_{81}Cu_{12}Ni_7$ | 850 | — | A - m |
| $Al_{80}Cu_{10}Ni_8Mo_{0.5}Si_{1.5}$ | 850 | 280 | A - m |
| $Al_{80}Mn_{18}Mo_2$ | 960 | 550 | m |
| $Al_{85}Cu_{12}Si_5$ | 850 | — | m |
| $Al_{83}Cu_8Ni_4Si_5$ | 850 | — | m |
| $Al_{77}Cu_{11}Ni_6Si_6$ | 850 | 250 | m |
| $Al_{78}Cu_{12}Mo_2Si_8$ | 850 | 320 | m |
| $Al_{80}Cu_{10}Mn_8Mo_2$ | 930 | — | m |
| $Al_{85}Cu_7Ni_5Mo_1Si_2$ | 850 | 490 | m |
| $Al_{77}Cu_{12}Cr_8Mo_1Si_2$ | 850 | 540 | m |
| $Al_{77}Cu_{12}Mn_8Mo_1Si_2$ | 850 | 390 | m |
| $Al_{83}Cu_{17}$ | 800 | — | m |
| $Al_{75}Cu_{13}Ni_{10}Mo_2$ | 930 | — | m |
| $Al_{97}Ni_3$ | 850 | — | M |

X
A: amorphous - m: microcrystalline - M = macrocrystalline

We claim:

1. A substantially amorphous or microcrystallized Al-based alloy, said alloy being of the formula: $Al_aM_b.Cu_{b'}M_{c'}X_dY_e$, wherein $a+b+b'+c+d+e=100$ and $50 \leqq a \leqq 95$ atom %, $15 \leqq b \leqq 40$ atom %, $6 \leqq b' \leqq 25$ atom %, $0 \leqq c \leqq 15$ atom %, $0 \leqq d \leqq 20$ atom % and $e \leqq 1$ atom %, and wherein M is an element selected from the group consisting of Mn, Ni, Zr, Cr, Ti, V, Fe and Co; M' is an element selected from the group consisting of Mo, W and mixtures thereof; X is an element selected from the group consisting of Ca, Li, Mg, Ge, Si and Zn; and Y represents the inevitably present impurities.

2. The aluminum-based alloy of claim 1, wherein element M' is Mo with the accompanying value of c being: $0.5 \leqq c \leqq 5$ atom %.

3. The aluminum-based alloy of claim 2, wherein element X is silicon and the value of d is: $0.5 \leqq d$ is $\leqq 9$ atom %.

4. The aluminum-based alloy of claim 1, which is an amorphous alloy, wherein said element M is vanadium with the value of b ranging from $15 \leqq b \leqq 25$ atom %.

5. The aluminum-based alloy of claim 1, which is an amorphous alloy, wherein element M is nickel having a b value ranging from $15 \leqq b \leqq 25$ atom %.

6. The aluminum-based alloy of claim 1, wherein said alloy is a microcrystallized alloy having a grain size less than about 1,000 nm.

7. The aluminum-based alloy of claim 6, wherein the grain size is about 100 nm.

* * * * *